US006865907B2

(12) United States Patent
Andrews et al.

(10) Patent No.: US 6,865,907 B2
(45) Date of Patent: Mar. 15, 2005

(54) VIBRATING, BODY-PIERCING JEWELRY

(76) Inventors: John T. Andrews, 166019, MCI-J, P.O. Box 549, Jessup, MD (US) 20794; Kenneth R. Whittinghill, 12636 Sunset Ave. G-4, Ocean City, MD (US) 21842

( * ) Notice: Subject to any disclaimer, the term of this patent is extended or adjusted under 35 U.S.C. 154(b) by 241 days.

(21) Appl. No.: 09/812,558

(22) Filed: Mar. 21, 2001

(65) Prior Publication Data

US 2001/0047664 A1 Dec. 6, 2001

Related U.S. Application Data

(60) Provisional application No. 60/195,201, filed on Apr. 7, 2000.

(51) Int. Cl.[7] ..... A44C 7/00

(52) U.S. Cl. ..... 63/12; 601/601; 601/46; 601/70

(58) Field of Search ..... 601/70, 46, 79; 63/12

(56) References Cited

U.S. PATENT DOCUMENTS

| | | | | | |
|---|---|---|---|---|---|
| 3,750,655 | A | * | 8/1973 | Kolbel | 601/133 |
| 4,353,225 | A | * | 10/1982 | Rogers | 40/301 |
| 4,459,645 | A | * | 7/1984 | Glatter | 362/104 |
| 4,719,544 | A | | 1/1988 | Smith | |
| D294,335 | S | | 2/1988 | Gatsos | |
| 4,781,036 | A | * | 11/1988 | Erickson | 606/188 |
| 4,840,045 | A | * | 6/1989 | Moody | 63/12 |
| 5,048,310 | A | * | 9/1991 | Riley | 24/615 |
| 5,097,679 | A | * | 3/1992 | Johnson et al. | 63/23 |
| 5,140,840 | A | * | 8/1992 | Miceli | 63/12 |
| 5,253,149 | A | | 10/1993 | Ostema et al. | |
| 5,361,241 | A | | 11/1994 | Ferrara et al. | |
| 5,377,692 | A | | 1/1995 | Pfeil | |
| 5,413,551 | A | * | 5/1995 | Wu | 601/31 |
| 5,484,390 | A | * | 1/1996 | Chiang | 601/133 |
| 5,553,467 | A | * | 9/1996 | Calabro | 24/514 |
| 5,622,062 | A | * | 4/1997 | Gong-Hwa | 63/15 |
| 5,683,421 | A | * | 11/1997 | Guarini et al. | 606/235 |
| 5,688,063 | A | * | 11/1997 | Yu et al. | 401/195 |
| 5,693,073 | A | * | 12/1997 | Glick et al. | 606/236 |
| D394,412 | S | | 5/1998 | Hanson | |
| 5,946,943 | A | | 9/1999 | Hanson | |
| 6,026,659 | A | * | 2/2000 | Kaping, Jr. | 63/12 |
| 6,158,439 | A | * | 12/2000 | Streetman | 128/898 |
| 6,193,742 | B1 | * | 2/2001 | Moriarty | 606/234 |
| 6,203,509 | B1 | * | 3/2001 | Duboff | 601/70 |
| 6,244,073 | B1 | * | 6/2001 | Kaping, Jr. | 24/105 |
| 6,419,649 | B1 | * | 7/2002 | Klein | 601/46 |

FOREIGN PATENT DOCUMENTS

| | | |
|---|---|---|
| FR | 2 651 650 | 3/1991 |
| GB | 2 036 537 | 7/1980 |

* cited by examiner

*Primary Examiner*—Robert J. Sandy
*Assistant Examiner*—Thomas Ho
(74) *Attorney, Agent, or Firm*—Richard C. Litman

(57) ABSTRACT

A vibrating, body-piercing jewelry item having a vibrating motor unit, a housing for the vibrating motor unit, a post, a keeper, retainer or clamping device for holding the item on a wearer's body, a power source for operating the vibrating motor unit, and an actuator for the vibrating motor unit. The vibrating, body-piercing jewelry may be worn on a part of the body that is either unpierced or pierced.

17 Claims, 4 Drawing Sheets

VIBRATING, BODY-PIERCING JEWELRY

CROSS-REFERENCE TO RELATED APPLICATION

This application claims the benefit of U.S. Provisional Patent Application Ser. No. 60/195,201, filed Apr. 7, 2000.

BACKGROUND OF THE INVENTION

1. Field of the Invention

The present invention relates to vibrating jewelry, and more specifically, to vibrating, body-piercing jewelry, powered by a battery and operated by a small vibrating motor unit.

2. Description of Related Art

The history of body piercing jewelry goes back for centuries and has its roots in tradition and culture. There is a growing popularity among younger people to pierce areas of their body parts normally not visible to others. Such body parts include the navel, nipples, penis, scrotum, clitoris, genital labia, and other genital areas.

The following related patents illustrate and describe various types of illuminating jewelry and vibrating devices.

U.S. Des. Pat. No. 294,335, issued to James L. Gatsos on Feb. 23, 1988, illustrates an ornamental design for a necklace pendant circlet in the shape of a horse-shoe. U.S. Des. Pat. No. 394,412, issued to Carl Ralph Hanson on May 19, 1998, shows an ornamental design for a piece of body piercing jewelry, which is a crescent-shaped body having terminal ends.

U.S. Pat. No. 5,946,943, issued to Carl Ralph Hanson on Sep. 7, 1999, teaches a crescent-shaped body piercing jewelry inserted within a pierced body part. U.S. Pat. No. 4,719,544, issued to Robert M. Smith on Jan. 12, 1988, explains an electronic illuminated jewelry piece in the form of an earring. The jewelry piece comprises a housing with a plurality of fiber-optic strands.

U.S. Pat. No. 5,253,149, issued to Ostema et al. on Oct. 12, 1993, teaches an illuminated jewelry piece including a light-emitting diode (LED) connected onto an enlarged flat base member. A miniature battery housing includes a stem cavity positioned immediately adjacent and coextensive with the battery compartment. The stem and the housing are structured so that an electrical circuit is completed between the battery and the LED through the stem when the stem is fully inserted to the bottom of the stem cavity.

U.S. Pat. No. 5,361,241, issued to Ferrara et al. on Nov. 1, 1994, discloses a wristwatch that alerts the wearer by vibrating the entire watchband. The watchband is vibrated using an electro-mechanical assembly and a flexible piezoelectric crystal embedded in the watchband.

U.S. Pat. No. 5,377,692, issued to William Pfeil on Jan. 3, 1995, describes a vibrating condom having an inflatable vibrating region which contacts the clitoris or vaginal walls. Air or fluid is transported from a power unit while the vibrating region is self-activated.

Great Britain Pat. No. 2,036,537A, issued July, 1980, shows a pendant including batteries and circuitry for an illuminated effect. France Pat. No. 2,651,650, issued March, 1991, discloses a solar-powered or battery operated jewel worm in the form of a badge, which includes energy distributor wired to an electric micromotor.

None of the above inventions and patents, taken either singly or in combination, is seen to describe the instant invention as claimed.

SUMMARY OF THE INVENTION

The present invention is a vibrating, body-piercing jewelry item having one or more vibrating motor units, a housing for each vibrating motor unit, a power source (e.g., a battery) for operating each vibrating motor unit, a clasp or clamping device, a post, a flexible barrier or insulator on the battery, and an actuator for each vibrating motor unit.

The vibrating, body-piercing jewelry is worn on a chosen part of the person's body. There are at least three different embodiments of the vibrating, body-piercing jewelry. The first embodiment of the vibrating, body-piercing jewelry has a post and clasp assembly. The second embodiment of the vibrating, body piercing-jewelry item includes an attachment means for adding chains and other decorative jewelry accessories to the present invention. The third embodiment of the vibrating, body-piercing jewelry item includes a clamping device.

Accordingly, it is a principal object of the invention to provide a vibrating, body-piercing jewelry item that is manufactured in a variety of shapes, colors, and sizes for aesthetic, amusement, and/or arousal purposes.

It is another object of the invention to provide a vibrating, body-piercing jewelry item which is easy to operate, and provides for ready battery changing.

It is a further object of the invention to provide a vibrating body-piercing jewelry item with a clamp assembly instead of a post and clasp assembly for the attachment to areas of the body that are not pierced.

Still another object of the invention is to provide a vibrating, body-piercing jewelry item that is water-resistant and can be waterproof.

It is an object of the invention to provide improved elements and arrangements thereof in a jewelry item for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
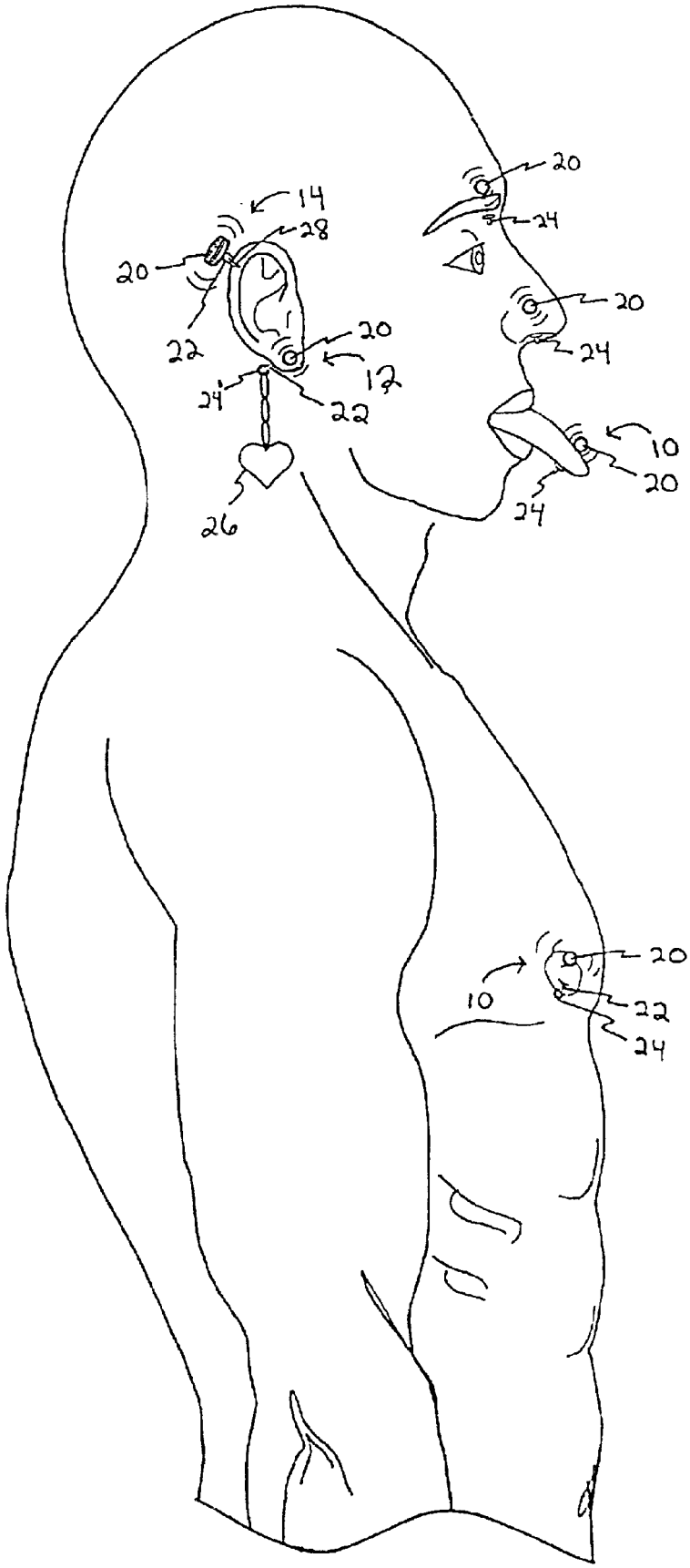
FIG. 1 is an environmental, perspective view of a person wearing several battery operated body piercing jewelry assemblies which are located on various part of the body, all according to the present invention.

The present invention is a battery operated vibrating, body-piercing jewelry item designated as 10 in the drawings. Each vibrating, body-piercing jewelry item 10 is made up of a vibrating motor unit, a housing for each vibrating motor unit, a power source for operating each vibrating motor unit, a post, a clasp or clamp, and a means to actuate each vibrating motor unit.

FIG. 1 demonstrates a number of examples 10, 12, and 14 and uses for each vibrating, body-piercing jewelry item. The vibrating, body-piercing jewelry will be manufactured in many different shapes and sizes. However, each vibrating, body-piercing jewelry item 10 has at least one vibrating motor unit, a housing 20 for each vibrating motor unit, a power source for operating each vibrating motor unit, a post 22, a retainer or keeper 24, 24' or clamp 28, and an actuator for each vibrating motor unit.

The vibrating, body-piercing jewelry 10 is worn on a person's pierced or unpierced body part. There are at least three different embodiments 10, 12, and 14 of the vibrating jewelry. The first embodiment 10 of the vibrating, body-piercing jewelry is a post 22 and keeper 24 assembly. An elongated post 22 extends out from the housing 20 and a keeper 24 is located on the free end of the elongated post 22 to hold the jewelry item 10 within the pierced area of the body part. The post 22 and keeper 24 assembly may comprise a one piece body or separate sections.

The second embodiment 12 of the vibrating, body-piercing jewelry item includes a centrally-open retainer 24' for adding chains and other decorative jewelry accessories 26 to the present invention 12. The third embodiment 14 of the vibrating, body-piercing jewelry item includes a clamping device 28. Preferably the clamping device 28 includes two symmetrically shaped jaws. The clamping device 28 includes a movable jaw which mates with a stationary jaw to form the clamp 28.

Two of the embodiments 10 and 12 of the vibrating, body-piercing jewelry items are constructed to be attached to any pierced body part. The third embodiment 14 of the vibrating, body-piercing jewelry which includes the clamp 28, which can be attached to anywhere on the body.

FIG. 1 illustrates examples of areas on the upper torso which the present invention 10 can be attached. There are many areas on the lower torso that the vibrating, body-piercing jewelry items 10 can be attached such as the genital areas of both male and females for arousal, aesthetics, etc. The entire vibrating, body-jewelry item 10 can also be manufactured in many different colors.

Figure 2:
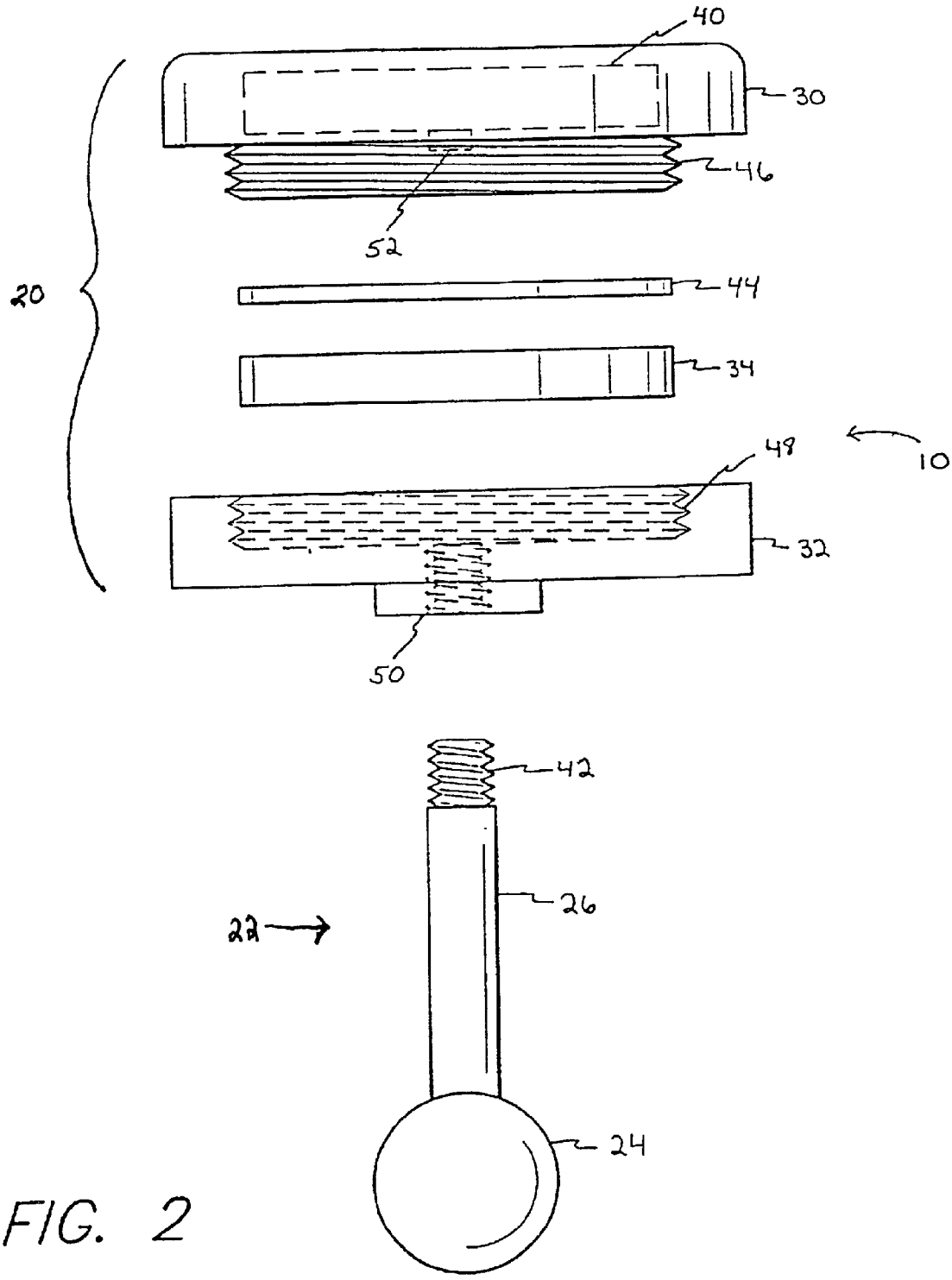
FIG. 2 is a side elevation, exploded view showing a first embodiment of a battery operated body piercing jewelry item.

FIG. 2 illustrates a first embodiment 10 of the vibrating, body-piercing jewelry item. The first embodiment 10 comprises a housing having first 30 and second 32 sections, a power source (e.g., a battery) 34, a post 26, a keeper or retainer 24, a vibrating motor unit 40, and a means to actuate the vibrating motor 42. The housing sections 30 and 32 may be constructed in any shape or size for aesthetic purposes. However the sections 30 and 32 are dimensioned and configured to contain the vibrating motor unit 40, the battery 34, and a barrier 44 which separates the battery 34 from the vibrating motor unit 40.

The first section 30 of the housing has a male threaded end 46 which is threadingly fitted into female threaded end 48 of the second section 32 of the housing. Any attachment means can be used to removably secure the two sections 30 and 32 of the housing. For example, the two sections 30 and 32 of the housing may be removably attached together by a frictional snapping means which is not shown. A rubber O-ring (not shown) may be used to ensure a water-tight seal to prevent water from leaking into the housing 30 and 32 where the battery 34 and vibrating motor unit 40 are located.

The second section 32 of the housing includes a threaded recess 50 which is dimensioned and configured to receive the threaded end 42 of the post 26. The post 26 is an elongated member having one end threaded 42 and the other end including the keeper 24 which prevents the pierced body part from sliding off the post 26.

The post 26 functions first as a structure used to insert the jewelry item 10 in place and to prevent the pierce body part from sliding off. Secondly, the post 26 acts as an actuator 42 for activating the vibrating motor unit 40. The flexible cushioned barrier 44 is dimensioned and configured to the shape of the battery 34 and includes a recess (not shown) which receives the positive node 52 point of the vibrating motor unit 40. The post 26 is threaded 42 into the threaded recess 50 in the second section 32 of the housing and acts as the actuator for turning on the vibrating motor unit 40. The post 26 moves the battery 34 against the vibrating motor unit 40 through a recess (not shown) in the barrier 44, thereby allowing battery current to pass to and activate the vibrating motor unit 40 and causing the entire jewelry item 10 to vibrate.

The keeper 24 and two sections 30 and 32 of the housing can be of any shape and size, but would normally be manufactured for aesthetic and amusement purposes. An insulating coat (not shown) might be applied onto the entire area of the battery 34 except the areas that would be exposed to the node 52 of the vibrating motor unit 40 and the threaded end 42 of the post 26.

Figure 3:
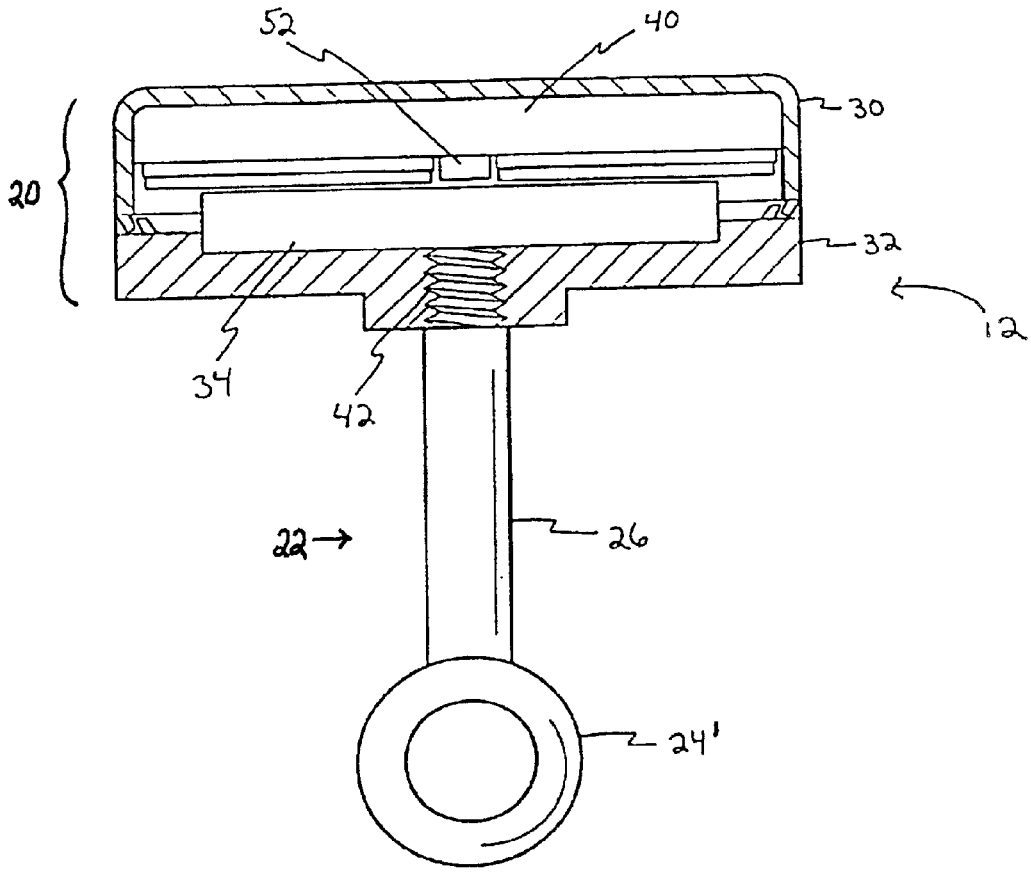
FIG. 3 is a part-sectional, elevational view of a second embodiment of a battery operated body piercing jewelry item.

FIG. 3 discloses a second embodiment 12 of the vibrating, body-piercing jewelry item. The second embodiment 12 also comprises a housing having two sections 30 and 32, a power source 34, a post 26, a clasp 24, a vibrating motor unit 40, and a means to actuate the vibrating motor 42. The operation of the vibrating motor unit 40 is also similar to the first embodiment 10. (Preferably, a battery 34 is used in all the embodiments 10, 12, and 14 of the present invention as the main power source that supplies electrical energy to the vibrating motor unit 40.)

The vibrating motor unit 40 is turned on by the post 26 moving the battery 34 against the vibrating motor unit 40, creating an electrical current which actuates the vibrating motor unit 40 and causing the entire jewelry item 12 to vibrate. A complete circuit is achieved when the threaded end 42 of the post 26 has moved the battery 34 to contact the positive node 52 of the vibrating motor unit 40.

A feature of the second embodiment 12 is the ring keeper 24, dimensioned and configured to receive a chain, charm, or other ornamental jewelry piece item 12. Preferably the ring keeper 24 is in the shape of a ring, but any shaped clasp 24 will suffice to secure other jewelry accessories to the vibrating, body-piercing jewelry 12.

Figure 4:
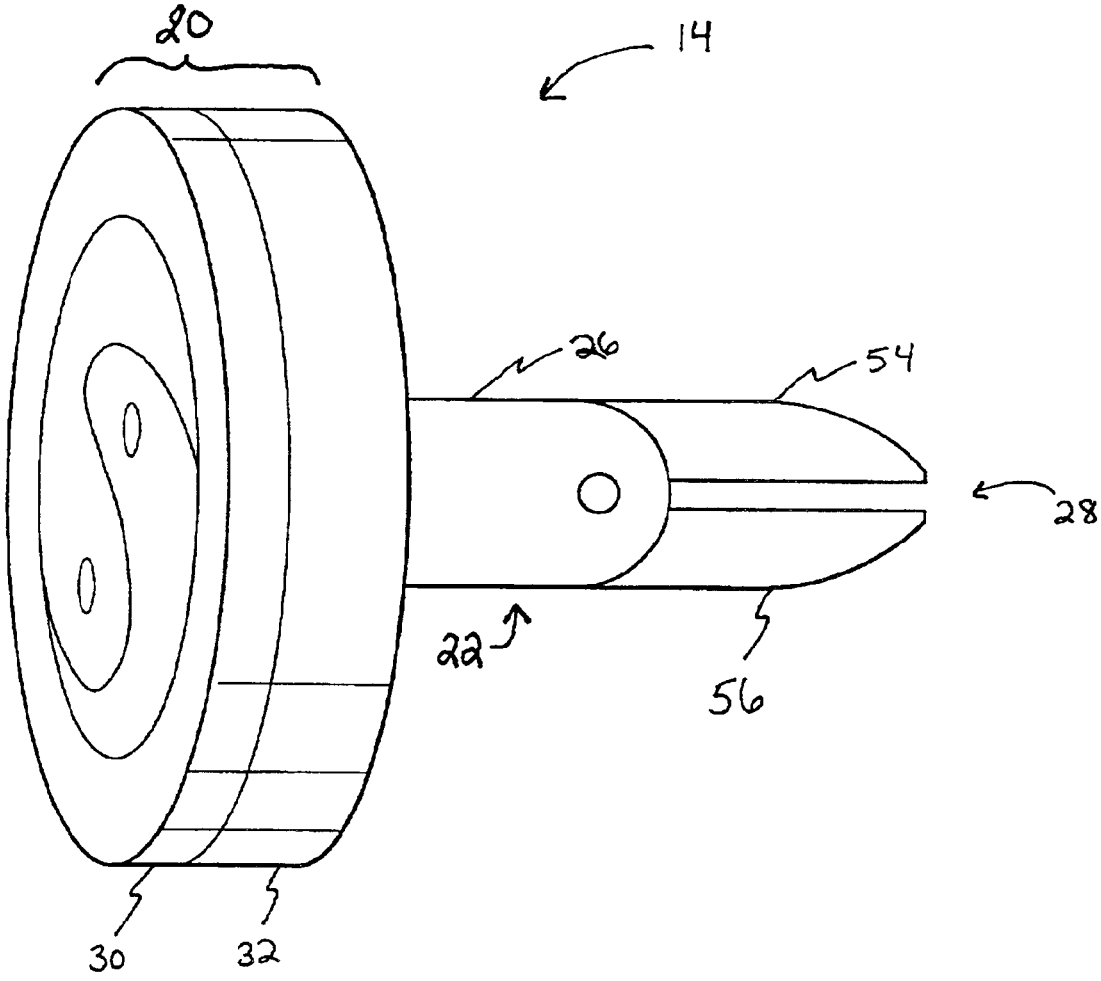
FIG. 4 is a perspective view of a third embodiment of a battery operated body piercing jewelry item, showing the clamp device.

FIG. 4 shows the third embodiment 14 of the vibrating body jewelry item. The third embodiment 14 comprises a housing having two sections 30 and 32, a power source (not shown), a post 26, a clamp or clamping device 28, a vibrating motor unit (not shown), and a means to actuate the vibrating motor unit (not shown). The operation of the vibrating motor unit is the same in the third embodiment 14. However, the keeper 24 is replaced with a clamp or clamping device 28.

The clamping device 28 includes two symmetrically shaped jaws. One is a movable jaw 54 that mates with a stationary jaw 56 to form the clamp device 28. There are many different types of body clamping devices 28 that are used with jewelry items are well known in the art. Any one of these clamping devices 28 can be used with the third embodiment 14 of the present invention. The clamping device 28 permits a user to clamp the vibrating jewelry item 14 onto an unpierced body part.

The clamping device 28 and clasps 24 could also be interchangeable between all three embodiments 10, 12, and 14. This can be achieved by having the end of the post 26 that is attached to the clamping device 28 or clasp 24 threadingly fit onto one another, thus making them interchangeable.

The vibrating body jewelry 10 can be of the disposable type. In this example, the housing of the present invention 10 may be constructed as a one piece body containing the vibrating motor unit 40 and battery 34. Another way to activate the vibrating motor unit includes having the housing itself act as an actuating means whereby tightening the threaded ends of the two section of the housing will move the battery onto the node of the vibrating motor unit.

It is to be understood that the present invention is not limited to the embodiments described above, but encompasses any and all embodiments within the scope of the following claims.

We claim:

1. A vibrating body jewelry item to be attached to a body part of a user, comprising:

a power source;

a vibrating motor unit;

a housing having a first and second section dimensioned and configured to contain said power source and said vibrating motor unit, each said first and second sections having mating ends that connect to one another, said second section having a threaded recess defined therein;

attachment means for securing the vibrating body jewelry item to a body part of a user; and a post having a threaded end, said housing being disposed at the threaded end of said post, and said attachment means being disposed at an opposite end of said post;

wherein said power source and said vibrating motor unit are disposed within said housing; and wherein said post extends through the threaded recess in said second section in order to move said power source onto said vibrating motor unit, thereby activating said vibrating motor unit.

2. The vibrating body jewelry item according to claim 1, wherein said power source is a battery.

3. The vibrating body jewelry item according to claim 1, wherein said ends of said first and second sections of said housing include thread means for threadingly connecting said sections together.

4. The vibrating body jewelry item according to claim 1, wherein said ends of said first and second sections of said housing have mating snap-fit structures for connecting said sections together.

5. The vibrating body jewelry item according to claim 1, wherein said second section of said housing includes a recess, and said power source is a battery, said battery being received on said recess.

6. The vibrating body jewelry item according to claim 1, wherein said attachment means for securing the vibrating body jewelry item to a body part of a user is a keeper.

7. The vibrating body jewelry item according to claim 6, wherein said keeper is configured to receive an attachment selected from the group consisting of a chain, charm, and other ornamental jewelry piece item.

8. The vibrating body jewelry item according to claim 1, wherein said attachment means for securing the vibrating body jewelry item to a body part of a user is a clamp.

9. The vibrating body jewelry item according to claim 8, wherein said clamp includes a movable jaw and a fixed jaw, said movable jaw mating with the fixed jaw to form said clamp device.

10. A vibrating body jewelry item to be attached to a body part of a user, comprising:

a power source;

a vibrating motor unit;

a housing dimensioned and configured to contain said power source and said vibrating motor unit;

a keeper for securing the vibrating body jewelry item to the body part of a user;

a post, said housing being disposed at one end of said post, said post being adapted for insertion through the body part of the user and said keeper being disposed at an opposite end of said post to retain the item on the body part;

wherein said power source and said vibrating motor unit are disposed within said housing.

11. The vibrating body jewelry item according to claim 10, wherein said post has a threaded end and said housing has a threaded recess formed therethrough, and wherein the threaded end extends through the threaded recess in order to selectively engage said vibrating motor unit with said power source.

12. The vibrating body jewelry item according to claim 10, wherein said keeper comprises a ring.

13. A vibrating body jewelry device for attachment to a body part of a user, comprising:

a housing having a threaded recess defined therein, said housing having a first section and a second section, the first and second sections having mating male and female threaded connectors;

a vibratory motor unit disposed in the housing, the vibratory motor unit having a contact node depending therefrom;

a battery disposed in the housing;

a flexible cushioned barrier disposed between the vibratory motor unit and the battery, the barrier having a recess defined therein aligned with the contact node;

at least one post having a threaded first end and having a second end, the first end being threaded into the recess defined in the housing; and attachment means for securing the vibrating body jewelry item to a body part of a user;

wherein, the post is movable between a first position in which the barrier separates the battery from the contact node in order to prevent the device from vibrating, and a second position in which the post forces the battery against the contact node in order to activate the vibratory motor unit.

14. The vibrating body jewelry device according to claim 13, wherein said attachment means comprises a keeper, the device being adapted for attachment to a pierced body part with the post extending through the body part, said housing and said keeper being adapted for preventing the post from sliding through the body part.

15. The vibrating body jewelry device according to claim 13, wherein said attachment means comprises a keeper, the keeper being ring-shaped, the device being adapted for attachment to a pierced body part with the post extending through the body part, said housing and said keeper being adapted for preventing the post from sliding through the body part, said ring-shaped keeper being adapted for receiving a chain, a charm, and ornamental jewelry items.

16. The vibrating body jewelry device according to claim 13, wherein said attachment means comprises a clamp having a fixed jaw and a movable jaw pivotally attached to the fixed jaw, the clamp being adapted for attachment to a body part.

17. The vibrating body jewelry device according to claim 13, wherein said at least one post further comprises:

a first post, the attachment means comprising a keeper, the device being adapted for attachment to a pierced body part;

a second post, the attachment means comprising a ring adapted for receiving an ornamental jewelry attachment, the device being adapted for attachment to a body part; and a third post, the attachment means comprising a clamp having a fixed jaw and a movable jaw pivotally attached to the fixed jaw, the device being adapted for attachment to a body part;

wherein said first, second and third posts are interchangeably attached to said housing in order to attach the device to a body part, whether the body part is pierced or unpierced.

* * * * *